US005966841A

United States Patent [19]

Barret

[11] Patent Number: 5,966,841

[45] Date of Patent: Oct. 19, 1999

[54] SPORT BOOT

[75] Inventor: Thierry Barret, Pringy, France

[73] Assignee: Salomon S.A., Cedex, France

[21] Appl. No.: 08/967,218

[22] Filed: Oct. 29, 1997

Related U.S. Application Data

[63] Continuation of application No. 08/554,806, Nov. 7, 1995, abandoned.

[30] Foreign Application Priority Data

Nov. 7, 1994 [FR] France ..... 94 13510

[51] Int. Cl.[6] ..... A43C 11/00; A43B 5/04

[52] U.S. Cl. ..... 36/50.1; 36/58.5; 36/117.2; 36/50.5

[58] Field of Search ..... 36/4, 91, 50.1, 36/58.5, 58.6, 50.5, 117.2

[56] References Cited

U.S. PATENT DOCUMENTS

| | | | |
|---|---|---|---|
| 1,286,787 | 12/1918 | Rikahr | 36/91 X |
| 2,591,211 | 4/1952 | Spencer | 36/58.5 X |
| 4,394,803 | 7/1983 | Goldstein | 36/50.1 X |
| 4,550,511 | 11/1985 | Gamm | 36/91 X |
| 4,811,500 | 3/1989 | Maccano | 36/91 |
| 5,566,474 | 10/1996 | Leick et al. | 36/50.1 |

FOREIGN PATENT DOCUMENTS

| | | |
|---|---|---|
| 0521287 A1 | 1/1993 | European Pat. Off. . |
| 2354723 | 1/1978 | France . |
| 2694167 | 2/1994 | France . |
| 1808115 | 5/1970 | Germany . |

*Primary Examiner*—Ted Kavanaugh
*Attorney, Agent, or Firm*—Pollock, Vande Sande & Amernick

[57] ABSTRACT

A sport boot having an external upper for protection against external damage, an assembly insole and an outer sole, and comprising an internal tightening system comprising two tightening quarters each having a lower end and being attached to said external upper only by that lower end. Internal lacing is arranged in the instep area. The external upper has a closed structure and with an opening only at its upper end and comprises external lacing for tightening the upper on the foot. The internal tightening system is substantially independent of the upper, a tongue element being provided beneath, but without physical connection to, the internal tightening system, and being attached to the upper at the front end of the boot and at a distance from the internal tightening quarters, so as to enable the tongue element to act as a lever for loosening the internal lacing.

11 Claims, 3 Drawing Sheets

SPORT BOOT

This application is a file wrapper continuation of U.S. patent application of Ser. No. 08/554,806, filed Nov. 7, 1995 now abandoned.

FIELD OF THE INVENTION

The invention relates to a sport boot, and, were specifically, a boot fulfilling a dual function, i.e., position-maintenance of the foot and protection of the foot from the outside elements, such as rain, snow, stones, etc., such as a walking boot intended for mountain and high mountain hiking or a cross-country ski, ski-touring, telemark, snowboard, or other boot.

BACKGROUND OF THE INVENTION

Traditionally, mountain, ski-touring, telemark, or other boots are strong, have high uppers, and are made of thick leather, in order to ensure good position-maintenance of the foot and ankle over all types of terrain, in particular fallen rocks and slopes, and good control of the sliding element when using ski, telemark, snowboard, and other skis.

These boots nevertheless have the disadvantage of being heavy, and fairly uncomfortable, and are difficult to lace around the foot because of the rigidity of the material used.

In addition, conventional practice, more specifically for glacier hiking, includes the use of so-called plastic shell boots, that is, boots in which the upper is made of a rigid synthetic material. These boots further comprise an inner, normally removable sock designed to ensure comfort of the foot inside the boot.

In this case, the foot is held by the sock by means of the deformation of the shell, which exerts stress on the sock.

Beside the difficulty of deforming the plastic shell in order to obtain the desired tightening effect, this type of boot also has the disadvantage that relative motion of the sock in relation to the shell can only the prevented, except by deforming the shell very forcefully on the sock and, thus generating strong pressures on the foot and causing discomfort.

Conventional practice, as revealed, for example, in Patent No. FR 2 678 487, encompasses manufacture of a walking boot comprising, inside an external upper, a foot-tightening device designed to hold the foot in place inside the boot independently of the external upper, which functions to protect against external conditions.

In this boot, the external upper is fitted on the top of the foot with a longitudinal opening extending from the ankle to the end of the foot, this opening being closed either by a zipper closure or by self-gripping means.

This boot does in fact clearly improve position-maintenance of the foot and inner comfort.

However, the longitudinal opening of the exterior upper on the top of the foot impairs the water-tightness of the boot as a whole.

These conventional boots also prove disadvantageous because they allow little proprioceptive sensation by the foot, as a result of the rigidity of the materials used for the upper.

SUMMARY OF THE INVENTION

The object of the present invention is to solve these problems and to provide an improved sport/walking/mountain/ski boot, and, in particular, a boot providing improved position-maintenance of the foot and water-tightness, while remaining as light as possible, and having good proprioceptive sensation characteristics.

The sport boot according to the invention, which comprises an internal tightening device arranged in the instep area and an external upper protecting against exterior damage, and incorporating an opening for the passage of the foot and means for closing this opening, allows this object to be achieved by virtue of the fact that the external upper opens only at its upper end, while its front part is a completely-closed structure fitted with at least one bellows-type extension which opens the upper so as to permit insertion of the foot, the means used to close the opening in the upper being constituted by a lacing system arranged above the bellows-type extension.

In fact, the elimination of the longitudinal opening extending over the entire front of the foot as it exists in conventional boots allows significant improvement of the impermeability of the boot. In addition, it was observed, in accordance with a finding that could not have been deduced from prior practice, that a construction of this kind is compatible with the use of an internal tightening device, and that the opening of the upper permitted by the bellows extension is sufficient to make the internal tightening device accessible.

A light, water-tight boot construction is thus produced, since the internal tightening system utilizing tightening quarters is much lighter that an internal tightening system incorporating a dual upper or inner sock.

According to one embodiment, the lacing system of the external upper extends from the top of the upper to the end of the foot. In this way, the lacing system of the external upper can also be used as additional means for holding the foot in place inside the boot.

According to a preferred embodiment, the inner wall of the upper is lined with an elastic foam material, at least in the part of the boot corresponding to the front part of the foot, so as to obtain, when the external upper is laced, contact between the foot and the foam in the absence of any compression of the parts in contact with the foot.

In fact, it was found that this simple contact between the foot and the foam gave an especially high degree of proprioceptive sensitivity when climbing, since it provides information about balance, positioning, and movement of the body.

Finally, according to another embodiment, the means used to tighten the internal tightening quarters are constituted by lacing connecting the two quarters by means of reversing elements arranged on these quarters, and by a stopper arranged at the free end of the lace. Accordingly, the inner tightening of the foot is facilitated still further, despite the restricted opening of the upper, given that one need merely generate traction on the free end of the lace until the desired tightening tension is obtained, and then immobilize the lace in the position obtained using the lace stopper.

BRIEF DESCRIPTION OF THE DRAWINGS

The invention will be better understood and other features thereof will emerge from the following description provided with reference to the attached schematic drawings, which illustrate a preferred embodiment, and in which.

DETAILED DESCRIPTION

Figure 1:
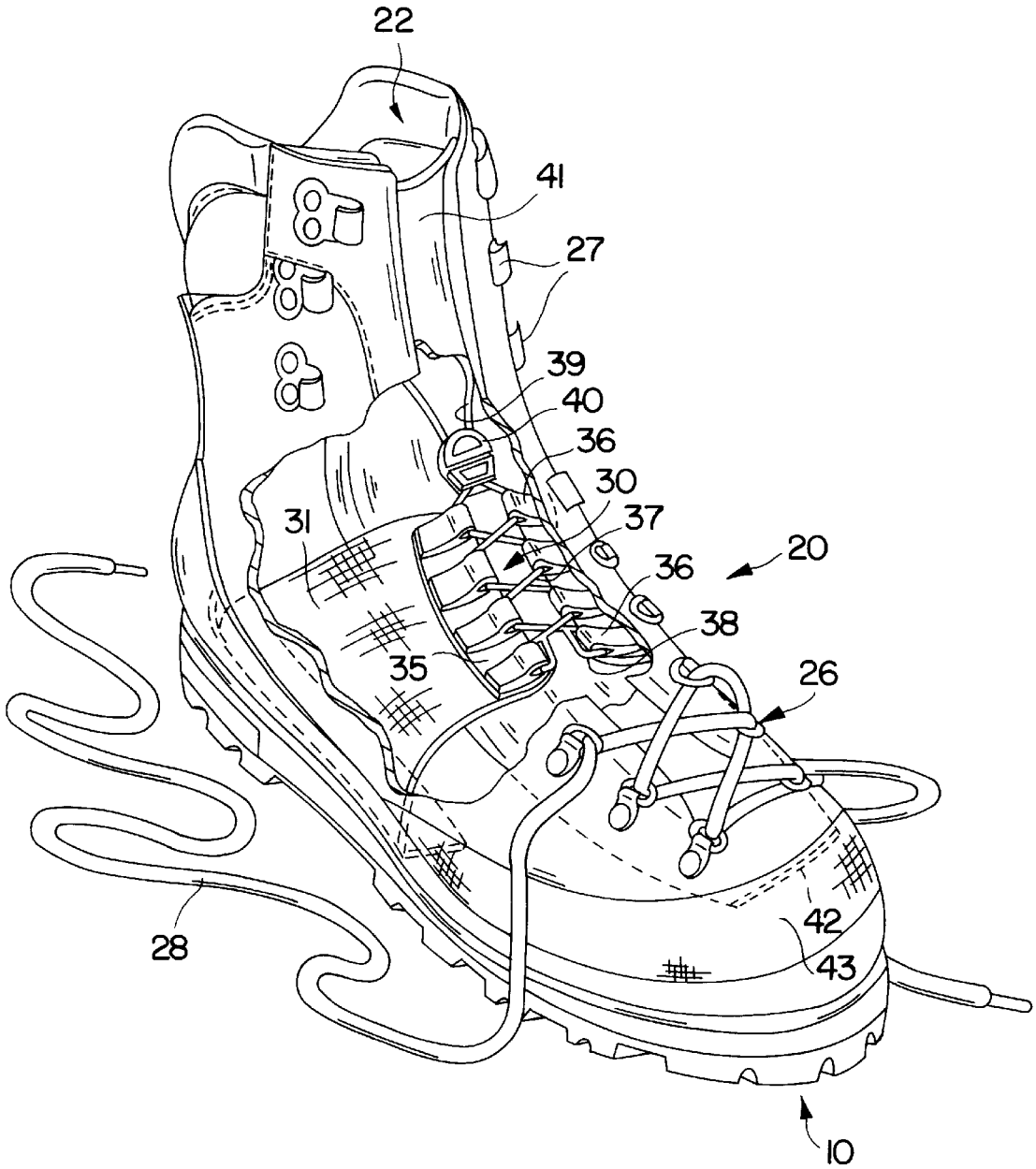
FIG. 1 is a three-quarters partially torn-away perspective view of a boot according to the invention.

As shown in FIG. 1, the sport boot, and, more especially, the hiking boot, according to the invention comprises an outer sole, termed a hiking sole 10, an external upper 20, and an internal tightening system 30.

The internal tightening system is, in conventional fashion, constituted by two tightening quarters or bands 31 made of a flexible material and arranged in the boot instep area.

Each tightening quarter 31 is attached conventionally by its lower end 32 to the lower edge of the boot, in the embodiment under consideration between the outer sole 10 and the assembly insole (not shown).

This lower end 32 of each tightening quarter, or of one only thereof, may also be attached to the upper at a different height, in order, for example, to tighten the foot on the inner, or medial, side of the boot, or to take into account requirements governing assembly of the upper/boot.

Figure 2:
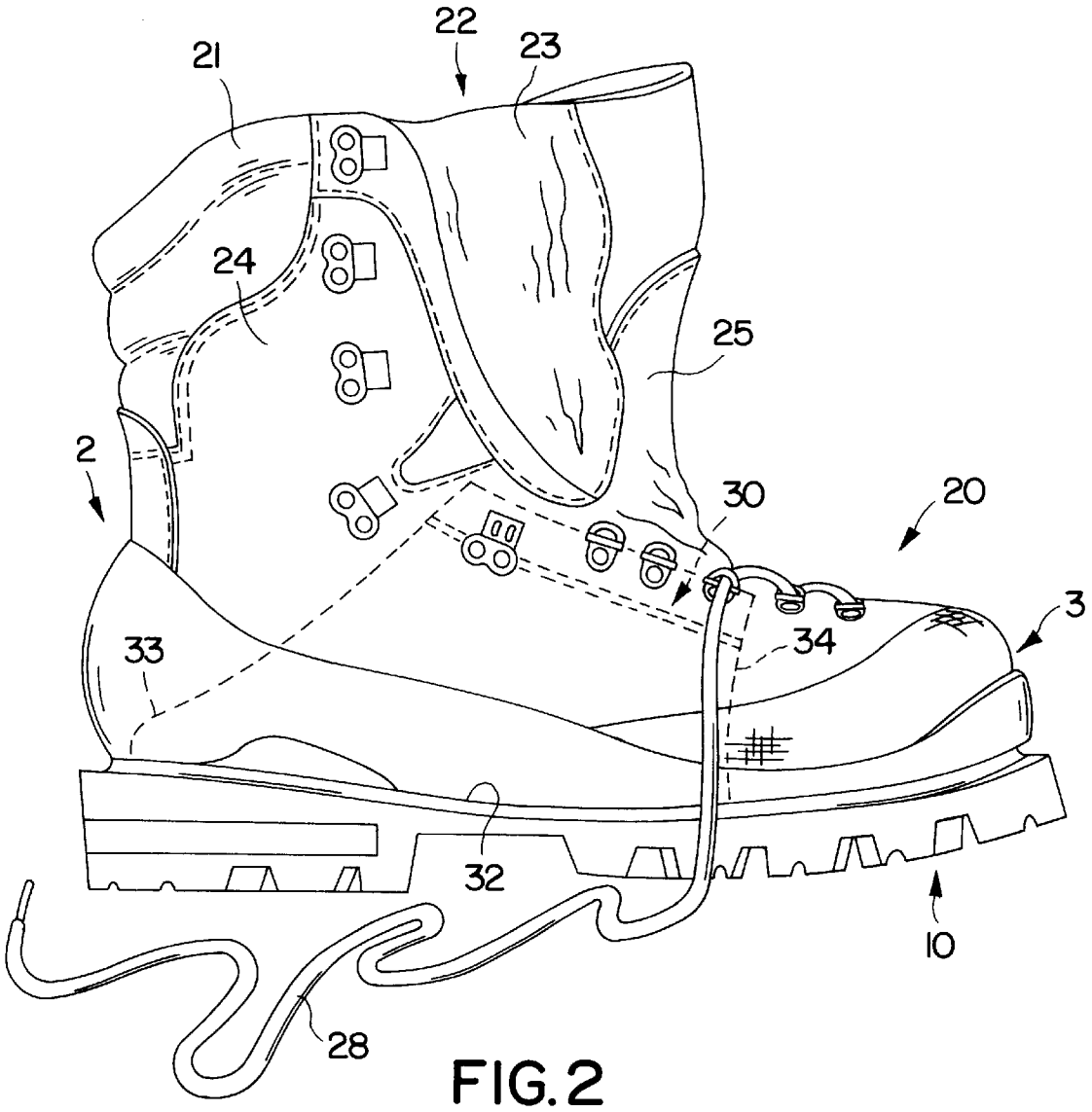
FIG. 2 is a side view of the boot in FIG. 1.

Moreover, the rear edge 33 of each tightening quarter 31 is attached to the extreme rear part of the boot, in the heel area 2 thereof, as shown in FIG. 2, so as to obtain optimal position-maintenance of the foot at the rear and to prevent the foot from sliding forward during descents.

The front edge 34 extends to the lower boundary of the instep area, normally called the lower instep.

As shown more especially in FIG. 1, each tightening quarter 31 comprises at its free upper edge 35 a series of guides or reversing elements 36 for a lace 37.

In the example illustrated, each guide 36 is constituted by a loop-shape folded-over strap. This embodiment has the advantage of minimal excess thickness, and is thus suitable for tightening by means of the external upper without producing excess pressure or pressure points in the area of the guides.

Depending on the intended embodiment or use, the guides may be replaced by metal buckles, hooks, etc.

According to a preferred embodiment, the lace 37 extends in alternating fashion over each of the tightening quarters 31 and is anchored by each of its free ends 38 in the last guide 36 located on the front edge 34 of each tightening quarter 31.

The lace 37 then describes, at the end opposite the anchoring points 38, a closed loop 39 constituting a gripping and traction element allowing tightening of the tightening quarters 31.

This anchoring method is especially advantageous, since the loop 39 forms a single gripping element allowing generation of symmetrical traction stress on each of the strands of the lace.

In addition, a lace stopper 40 which slides on the strands of the lace in the area of the loop 39 makes it possible to immobilize the strands in the desired tightening position.

Of course, the lace 37 could also be mounted conventionally, with the loop 39 being located at the lower end of the lacing system and the lace stopper 40 arranged on the free ends of the lace, this configuration having, however, the disadvantage of possible asymmetrical tightening.

In both cases, the tightening system equipped with a stopper is especially advantageous, since the tightening stress can be generated with one hand, the user then having only to move the stopper to the desired position with the other hand.

Furthermore, the use of this tightening system incorporating a lace stopper is especially advantageous when used in a small space inside a closed upper.

Finally, the stopper can have a flat shape, without creating any excess thickness capable of forming areas in which stresses or excess pressure are exerted on the foot.

A tongue 41 is provided conventionally beneath the internal tightening system, in order to prevent excess pressures in the instep area.

This tongue 41 is attached in conventional fashion to the front end of the boot by a seam 42.

In the embodiment shown, seam 42 is covered by a rubber strip 43 surrounding the upper, so as to assure impermeability.

It will be noted that the attachment of the tongue 41 at a distance from the internal tightening quarters allows it to be used as a lever to loosen the lace 37.

The external upper 20 of the boot is preferably made as a single piece, as in the example shown, so as to eliminate all seams that might impair the overall impermeability of the boot.

As shown more especially in FIG. 2, the upper has only a single opening 22 provided solely at its upper end 21. In order to delimit, however, a passage sufficient to allow the foot to be positioned inside the boot, the upper comprises, on its upper vertical portion, two substantially triangular bellows-type extensions 23 which close the opening conventionally provided between the lateral quarters 24 and the front vamp 25.

Accordingly, the upper 20 has a closed structure, except for the top opening 22, and is, therefore, extremely watertight.

The bellows extensions 23, which are preferably made of a material that is more flexible than that composing the rest of the upper in order to allow easy "collapsing" of the upper, thus allow a wide opening of the top of the upper 22 to allow insertion of the foot.

Once the foot is positioned, the upper can be collapsed, as shown in FIG. 1, and secured around the foot.

As shown more particularly in FIG. 2, the upper 20, and especially the front vamp 25 thereof, is designed to incorporate enough width so that its opening 22 extends substantially to a point lying in a straight vertical line above the lower edges 34 of the tightening quarters 31. In this way, easy accessibility is assured up to the lower end of the lacing in the internal tightening system.

The upper 20 comprises, moreover, a lacing/tightening system 26 composed of reversing elements 27 such as hooks, a buckle, and a lace 28 which extends on the vertical portion of the upper, but also over the entire top of the foot up to the end of the boot 3.

This lacing system 26 makes it possible not only to "close" the opening 22 around the leg, but also to tighten the upper 20 around the foot.

Accordingly, a double internal-external tightening action is produced allowing appreciable increase of foot position-maintenance and comfort.

The internal tightening system thus makes it possible, more especially, to attach the foot to the sole of the boot and, therefore, to produce more direct contact with the ground, thereby providing, "less play," better transmission and sensing of information coming from the ground, and, surprisingly, the impression of wearing a much lighter boot, since it "responds" immediately.

The external upper gives protection of the foot against external elements (water, snow, cold, impacts) and is made of a material suited for this function (e.g., leather). In the case of a ski, snowboard, or other boot, the upper can also comprise reinforcements suitable for transmission of stresses, support holds, etc., which occur in this type of sport.

Finally, external tightening allows precise adjustment of the outer volume of the upper around the foot, and is thus especially advantageous as regards the reception of proprioceptive sensations which provide information about balance, positioning, and movements of the body. These proprioceptive sensations are especially valued in sliding or climbing sports.

To amplify the proprioceptive sensation effect, the inner wall of the upper 20 may be lined with an elastic foam material, such as polyurethane, at least on the part of the boot corresponding to the front part of the foot, which exhibits excellent proprioceptive sensitivity. The foam lining in fact ensures that, once it is laced, the upper fits with a high degree of precision in contact with the foot, without producing any compression points whatever on the foot, since the foam allows compensation for differences in volume linked to anatomy and, therefore, establishment of the closest possible upper-foot contact.

Preferably, the foam lining is provided on the inner surface of the upper and has a thickness chosen the basis of intended use.

Figure 3:
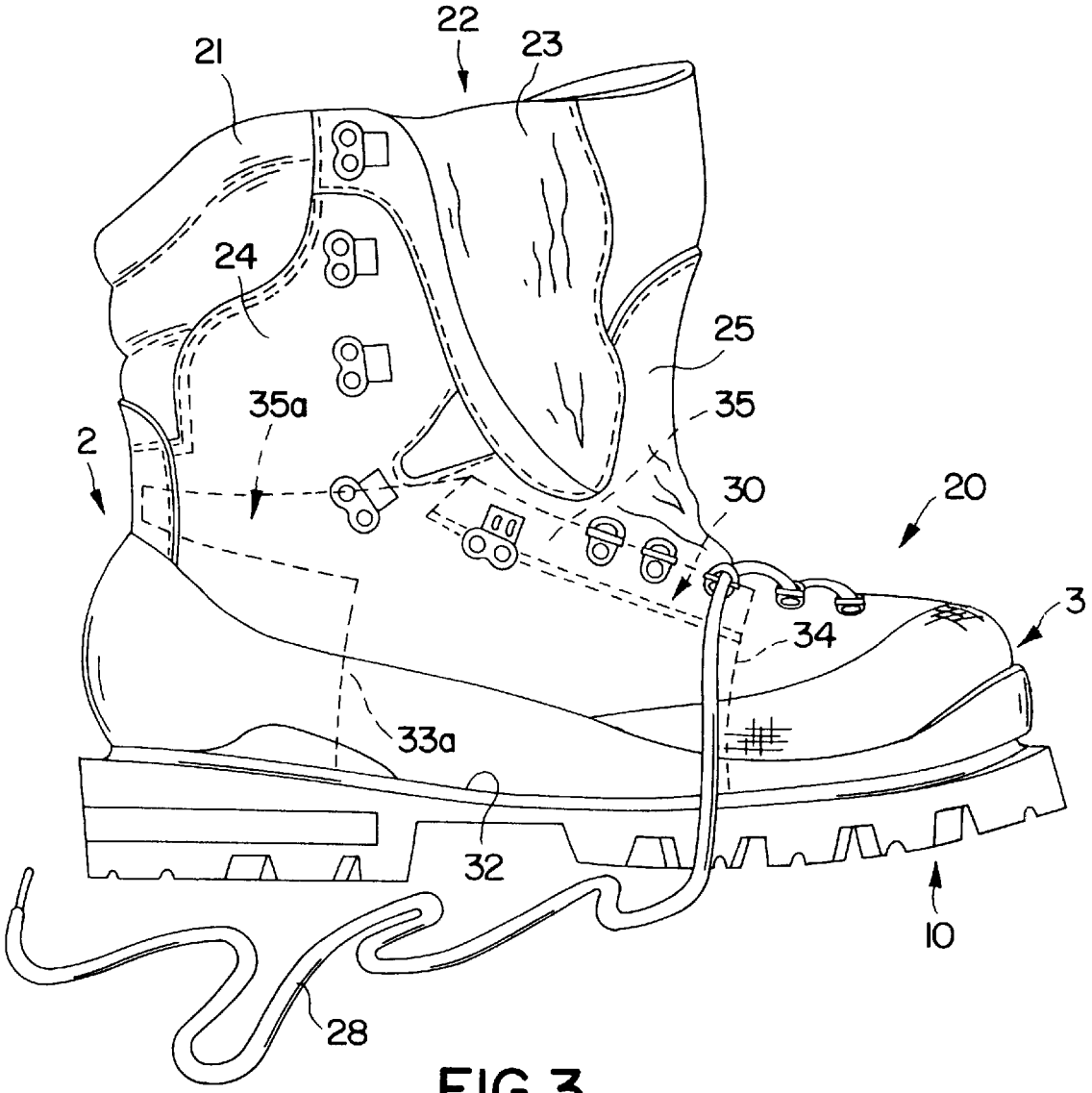
FIG. 3 is a view similar to FIG. 2 of another embodiment of the boot.

FIG. 3 shows a boot having the same features as the boot in FIG. 2, with the exception of the internal tightening device. In this case, the internal tightening system 30 is also constituted by two tightening quarters 31 arranged in the instep area of the boot.

The difference lies in the fact that the rear edge 33*a* of each tightening quarter 31 extends in a more vertical direction than the rear edge 33 of the tightening quarters of the FIG. 2 embodiment.

In this case, rearward position-maintenance of the foot or position-maintenance of the heel is ensured by a substantially horizontal strip 35*a* connecting the two upper edges 35 of each tightening quarter 35, so as to form a kind of continuous strip around the heel.

What is claimed is:

1. A sport boot having an external upper for protection against external damage, an assembly insole and an outer sole, and comprising an internal tightening system comprising two tightening quarters having a lower end attached to a lower edge of said boot between said assembly insole and said outer sole, and including internal lacing means arranged in an instep area, and a tongue element, said external upper having a closed structure and having an opening only at an upper end thereof, said external upper having at least one bellows type extension enabling wide opening of said upper so as to permit insertion of a foot, said external upper further comprising external lacing means for tightening said upper on said foot, said internal tightening system being substantially independent of said upper, said tongue element being provided beneath, but without physical connection to, said internal tightening system, and being attached to the upper at a front end of the boot and at a distance from said internal tightening quarters, so as to enable said tongue element to act as a lever for loosening said internal lacing means of said internal tightening system.

2. The sport boot according to claim 1, wherein the two tightening quarters (31) are joined in a continuous strip (35*a*) around the heel.

3. The sport boot according to claim 1, wherein said external lacing means extend from an upper end of said upper to said instep area.

4. The sport boot according to claim 3, wherein said external lacing means on said external upper extends to an end of the boot.

5. The sport boot according to claim 1, wherein a rear edge of each tightening quarter is attached in an area of the boot heel.

6. The sport boot according to claim 1, wherein the means for tightening the tightening quarters are constituted by a lace connecting the two quarters by means of reversing elements arranged on these quarters and by a stopper fitted on a free end of the lace.

7. The sport boot according to claim 6, wherein each of the ends of the lace is anchored at the front end of a tightening quarter.

8. The sport boot according to claim 6, wherein each reversing element is constituted by a buckle-shaped folded strap.

9. The sport boot according to claim 1, wherein said upper is produced as a single piece.

10. The sport boot according to claim 1, wherein an internal wall of said upper is lined with an elastic foam material.

11. A sport boot according to claim 1, further comprising a second tongue element underlying said external lacing means, said second tongue element being constituted by a central portion of said external upper.

* * * * *